US008734542B2

(12) United States Patent
Krull et al.

(10) Patent No.: US 8,734,542 B2
(45) Date of Patent: May 27, 2014

(54) DETERGENT ADDITIVE-CONTAINING MINERAL OILS HAVING IMPROVED COLD FLOW PROPERTIES

(75) Inventors: Matthias Krull, Harxheim (DE); Robert Janssen, Bad Soden (DE)

(73) Assignee: Clariant Finance (BVI) Limited, Tortola (VG)

( * ) Notice: Subject to any disclaimer, the term of this patent is extended or adjusted under 35 U.S.C. 154(b) by 371 days.

(21) Appl. No.: 12/664,997

(22) PCT Filed: Jun. 17, 2008

(86) PCT No.: PCT/EP2008/004852

§ 371 (c)(1), (2), (4) Date: Dec. 16, 2009

(87) PCT Pub. No.: WO2008/155090

PCT Pub. Date: Dec. 24, 2008

(65) Prior Publication Data

US 2010/0192455 A1 Aug. 5, 2010

(30) Foreign Application Priority Data

Jun. 20, 2007 (DE) ..... 10 2007 028 306

(51) Int. Cl.
*C10L 1/18* (2006.01)

(52) U.S. Cl.
USPC ..... 44/393; 44/348; 44/394; 44/395; 44/403; 44/408

(58) Field of Classification Search
USPC ..... 44/348, 393, 394, 395, 403, 408
See application file for complete search history.

(56) References Cited

U.S. PATENT DOCUMENTS

| | | | | |
|---|---|---|---|---|
| 3,961,916 | A * | 6/1976 | Ilnyckyj et al. | 44/395 |
| 4,022,589 | A | 5/1977 | Alquist et al. | |
| 4,108,613 | A | 8/1978 | Frost | |
| 4,211,534 | A * | 7/1980 | Feldman | 44/394 |
| 4,357,148 | A | 11/1982 | Graiff | |
| 4,670,516 | A | 6/1987 | Sackmann et al. | |
| 4,678,479 | A | 7/1987 | Holmes et al. | |
| 4,968,321 | A | 11/1990 | Sung et al. | |
| 5,006,130 | A | 4/1991 | Aiello et al. | |
| 5,186,720 | A | 2/1993 | Feustel et al. | |
| 5,286,264 | A | 2/1994 | Russo et al. | |
| 5,391,632 | A | 2/1995 | Krull et al. | |
| 5,766,273 | A | 6/1998 | Dralle-Voss et al. | |
| 5,998,530 | A * | 12/1999 | Krull et al. | 524/474 |
| 6,733,550 | B1 * | 5/2004 | Grundy et al. | 44/348 |
| 7,347,881 | B2 | 3/2008 | Krull et al. | |
| 8,153,567 | B2 | 4/2012 | Krull et al. | |
| 2010/0170146 | A1 | 7/2010 | Krull et al. | |
| 2010/0180492 | A1 | 7/2010 | Krull et al. | |
| 2010/0192456 | A1 | 8/2010 | Krull et al. | |

FOREIGN PATENT DOCUMENTS

| | | |
|---|---|---|
| DE | 29 21 330 | 12/1979 |
| EP | 0 154 177 | 9/1985 |
| EP | 0 398 101 | 11/1990 |
| EP | 0 413 279 | 2/1991 |
| EP | 0 606 055 | 7/1994 |
| EP | 0 777 712 | 3/1996 |
| EP | 1 801 187 | 6/2007 |
| WO | WO 95/03377 | 2/1995 |
| WO | WO 96/06902 | 3/1996 |
| WO | WO 99/28419 | 6/1999 |
| WO | WO 03/042337 | 5/2003 |

OTHER PUBLICATIONS

International Search Report for PCT/EP2008/004852 dated Oct. 2, 2008.
Translation of International Preliminary Report on Patentability for PCT/EP2008/004852, Oct. 2, 2008.
International Search Report for PCT/EP2008/004853 dated Oct. 9, 2008.
Translation of International Preliminary Report on Patentability for PCT/EP2008/004853, Oct. 9, 2008.
International Search Report for PCT/EP2008/004851 dated Oct. 2, 2008.
Translation of International Preliminary Report on Patentability for PCT/EP2008/004851, Oct. 2, 2008.
International Search Report for PCT/EP2008/004850 dated Oct. 2, 2008.
Translation of International Preliminary Report on Patentability for PCT/EP2008/004850, Oct. 2, 2008.
English Abstract for DE 29 21 330, dated Dec. 6, 1979.
English Abstract for EP0398101, dated Nov. 22, 1990.
"Winter Diesel Fuel", http://en.wikipedia.org/w/index.php?oldid=527895307, 2012.

* cited by examiner

*Primary Examiner* — Cephia D Toomer
(74) *Attorney, Agent, or Firm* — Tod A. Waldrop

(57) ABSTRACT

The invention relates to the use of at least one oil-soluble compound B) which acts as a nucleating agent for paraffin crystallization and which is selected from ethylene copolymers and 2 to 10.5 mole % of at least one ethylenically unsaturated carbonic ester for improving the response of cold flow improvers for mineral oils C), which are different from B), in middle distillates that contain at least one ashless, nitrogenous detergent additive A), which is an oil-soluble, amphiphilic compound that comprises at least one alkyl or alkenyl group bound to a polar group, said alkyl or alkenyl group having 10 to 500 C atoms and the polar group having 2 or more nitrogen atoms.

19 Claims, No Drawings

DETERGENT ADDITIVE-CONTAINING MINERAL OILS HAVING IMPROVED COLD FLOW PROPERTIES

The present invention relates to the use of nucleating agents for improving the cold flowability of mineral oil distillates comprising detergent additives, and to the additized mineral oil distillates.

The ever greater stringency of environmental protection laws is requiring ever more demanding engine technology to comply with the emissions limits laid down. However, coverage of engine parts, for example of the valves, with combustion residues changes the characteristics of the engine and leads to increased emissions and also to increased consumption. Detergent additives which remove such deposits and/or prevent their formation are therefore added to motor fuels. They are generally oil-soluble amphiphiles which, in addition to an oil-soluble, thermally stable, hydrophobic radical, contain a polar head group.

On the other hand, in view of decreasing global oil reserves, ever heavier and hence paraffin-richer crude oils are being extracted and processed, which consequently also lead to paraffin-richer fuel oils. The paraffins present in middle distillates in particular can crystallize out as the temperature of the oil is lowered and agglomerate partly with intercalation of oil. This crystallization and agglomeration can result, in winter in particular, in blockages of the filters in engines and boilers, which prevents reliable dosage of the fuels and, under some circumstances, can cause complete interruption of the fuel supply. The paraffin problem is additionally worsened by the hydrogenating desulfurization of fuel oils, which is increasing for environmental protection reasons for the purpose of lowering the sulfur content, and leads to an increased proportion of cold-critical paraffins in the fuel oil.

The cold flow properties of middle distillates are often improved by adding chemical additives known as cold flow improvers or flow improvers, which modify the crystal structure and agglomeration tendency of the paraffins which precipitate out such that the oils thus additized can still be pumped and used at temperatures which are often more than 20° C. lower than in the case of unadditized oils. The cold flow improvers used are typically oil-soluble copolymers of ethylene and unsaturated esters, oil-soluble polar nitrogen compounds and/or comb polymers. In addition, further additives have also been proposed.

In view of ever more demanding engine technology and rising demands on the environmental compatibility of fuel oils and their combustion products, detergent additives with ever higher effectiveness are being developed. In addition, they are often used in very high dosages. It is reported that, as a result, for example in the case of diesel fuels, the specific consumption is reduced and the performance of the engines is increased. However, these additives frequently have adverse effects on the cold flowability of middle distillates and in particular on the effectiveness of known cold flow improvers. Especially in the case of middle distillates with low final boiling point and simultaneously low aromatics content, it is frequently difficult or even impossible to attain satisfactory cold flow performance by means of conventional flow improvers in the presence of modern detergent additives. Thus, addition of detergent additives often results in an antagonistic effect on the effectiveness of the added cold flow improvers being observed. This impairs the paraffin dispersancy of the middle distillate which is attained by paraffin dispersants, without it being restorable by increased dosage of paraffin dispersants. Often, the filterability, measured as the CFPP, of oils additized with cold flow improvers is thus also significantly reduced under cold conditions and can be compensated only by greatly increased dosage of the flow improver.

Particularly problematic detergent additives in this context are especially those which derive from higher polyamines, and those which have very high molecular weights caused, for example, by multiple alkylation and/or acylation of these polyamines. Likewise particularly problematic are those detergent additives whose hydrophobic radicals derive from highly sterically hindered olefins and/or from high molecular weight and/or polyfunctionalized poly(olefins).

It was thus an object of the present invention to improve the response behavior of cold flow improvers in middle distillates comprising detergent additives. It was a further object of the invention to provide a detergent additive which is an improvement over the prior art and does not impair the response behavior of cold flow improvers.

It has now been found that, surprisingly, particular oil-soluble compounds which act as nucleators for paraffin crystallization counteract the impairment of the effectiveness of customary cold flow improvers by nitrogen-containing detergent additives or remove this impairment.

The invention thus provides for the use of at least one oil-soluble compound B) which acts as a nucleator for paraffin crystallization and is selected from copolymers of ethylene and 2 to 10.5 mol % of at least one ethylenically unsaturated carboxylic ester for improving the response behavior of mineral oil cold flow improvers C) different than B) in middle distillates which comprise at least one ashless nitrogen-containing detergent additive A) which is an oil-soluble amphiphilic compound which comprises at least one alkyl or alkenyl radical which is bonded to a polar group, where the alkyl or alkenyl radical comprises 10 to 500 carbon atoms and the polar group 2 or more nitrogen atoms.

The invention further provides a process for improving the response behavior of mineral oil cold flow improvers C) in middle distillates which comprise ashless nitrogen-containing detergent additives A), and in which the ashless nitrogen-containing detergent additives A) are oil-soluble amphiphilic compounds which comprise at least one alkyl or alkenyl radical which is bonded to a polar group, where the alkyl or alkenyl radical comprises 10 to 500 carbon atoms and the polar group 2 or more nitrogen atoms, by adding to the oil at least one oil-soluble compound B) which is different from C), acts as a nucleator for paraffin crystallization and is selected from copolymers of ethylene and 2 to 10.5 mol % of at least one ethylenically unsaturated carboxylic ester.

The invention further provides additives comprising a) at least one ashless nitrogen-containing detergent additive A) which is an oil-soluble amphiphilic compound which comprises at least one alkyl or alkenyl radical which is bonded to a polar group, where the alkyl or alkenyl radical comprises 10 to 500 carbon atoms and the polar group 2 or more nitrogen atoms, and b) at least one oil-soluble compound B) which acts as a nucleator for paraffin crystallization and is selected from copolymers of ethylene and 2 to 10.5 mol % of at least one ethylenically unsaturated carboxylic ester.

In a preferred embodiment, in addition to the constituents A) and B), the additives contain a mineral oil cold flow improver C) different than B).

The combination of A) and B) is also referred to hereinafter as "inventive additive".

The invention further provides middle distillates having a sulfur content of less than 100 ppm and a 90% distillation point of less than 360° C., comprising a) at least one ashless nitrogen-containing detergent additive A) which is an oil-soluble amphiphilic compound which comprises at least one alkyl or alkenyl radical which is bonded to a polar group, where the alkyl or alkenyl radical comprises 10 to 500 carbon atoms and the polar group 2 or more nitrogen atoms, b) at least one oil-soluble compound B) which acts as a nucleator for paraffin crystallization and is selected from copolymers of ethylene and 2 to 10.5 mol % of at least one ethylenically unsaturated carboxylic ester, and c) at least one mineral oil cold flow improver C) different than B).

According to the invention, improving the response behavior of cold flow improvers C) is understood to mean that at least one cold property of middle distillates which is or can be adjusted by means of cold flow improvers C) and is impaired by the addition of a detergent additive A) is improved by addition of a compound B) which acts as a nucleating agent for paraffin crystallization. Specifically, the addition of the nucleating agent B) achieves the cold property which is or can be adjusted by the cold flow improver C) in the absence of the detergent additive A). Cold properties are understood to mean, individually or in combination, the pour point, the cold filter plugging point, the low temperature flow and the paraffin dispersancy of middle distillates.

The response behavior of flow improvers is particularly impaired in middle distillates which contain more than 10 ppm of a nitrogen-containing detergent additive A), particularly more than 20 ppm and especially more than 40 ppm, for example 50 to 2000 ppm, of nitrogen-containing detergent additive A).

The inventive additives preferably contain, based on one part by weight of the nitrogen-containing detergent additive A), 0.01 to 10 parts by weight and especially 0.05 to 5 parts by weight, for example 0.1 to 3 parts by weight, of the oil-soluble compound B) which acts as a nucleator for paraffin crystallization.

"Ashless" means that the additives in question consist essentially only of elements which form gaseous reaction products in the combustion. The additives preferably consist essentially only of the elements carbon, hydrogen, oxygen and nitrogen. More particularly, ashless additives are essentially free of metals and metal salts.

Nucleators are understood to mean compounds which initiate the crystallization of paraffins in the course of cooling of a paraffin-containing oil. They thus shift the commencement of paraffin crystallization of the oil additized therewith, which can be determined, for example, by measuring the cloud point or the wax appearance temperature (WAT), to higher temperatures. These compounds are soluble in the oil above the cloud point and begin to crystallize out just above the paraffin saturation temperature in order then to serve as nuclei for the crystallization of the paraffins. They thus prevent oversaturation of the oil with paraffins and lead to crystallization close to the saturation concentration. This leads to the formation of a multitude of equally small paraffin crystals. In the presence of a nucleator, paraffin crystallization thus commences at a higher temperature than in the unadditized oil. This can be determined, for example, by measuring the WAT by means of differential thermal analysis (differential scanning calorimetry, DSC) in the course of slow cooling of the oil at, for example, −2 K/min.

Preferably 10 to 10 000 ppm and especially 50 to 3000 ppm of the nitrogen-containing detergent additives A) are added to middle distillates.

The alkyl or alkenyl radical preferably imparts oil solubility to the detergent additives.

Particularly problematic detergent additives are those whose alkyl radical has 15 to 500 carbon atoms and especially 20 to 350 carbon atoms, for example 50 to 200 carbon atoms. This alkyl radical may be linear or branched, and is especially branched. In a preferred embodiment, the alkyl radical derives from oligomers of lower olefins having 3 to 6 carbon atoms, such as propene, butene, pentene or hexene and mixtures thereof. Preferred isomers of these olefins are isobutene, 2-butene, 1-butene, 2-methyl-2-butene, 2,3-dimethyl-2-butene, 1-pentene, 2-pentene and isopentene, and mixtures thereof. Particular preference is given to propene, isobutene, 2-butene, 2-methyl-2-butene, 2,3-dimethyl-2-butene and mixtures thereof. Especially preferred are olefin mixtures which contain more than 70 mol %, especially more than 80 mol %, for example more than 90 mol % or more than 95 mol %, of 2-methyl-2-butene, 2,3-dimethyl-2-butene and/or isobutene. Particularly suitable for the preparation of such detergent additives are high-reactivity low molecular weight polyolefins having a proportion of terminal double bonds of at least 75 mol %, especially at least 85% and in particular at least 90%, for example at least 95%. Particularly preferred low molecular weight polyolefins are poly(isobutylene), poly(2-butene), poly(2-methyl-2-butene), poly(2,3-dimethyl-2-butene), poly(ethylene-co-isobutylene) and atactic poly(propylene). The molecular weight of particularly preferred polyolefins is between 500 and 3000 g/mol. Such oligomers of lower olefins are obtainable, for example, by polymerization by means of Lewis acids such as $BF_3$ and $AlCl_3$, by means of Ziegler catalysts and especially by means of metallocene catalysts.

The polar component of the detergent additives which are particularly problematic for the response behavior of known cold additives derives from polyamines having 2 to 20 nitrogen atoms. Such polyamines correspond, for example, to the formula $$(R^9)_2N\text{-}[A\text{-}N(R^9)]_q\text{—}(R^9)$$

in which each $R^9$ is independently hydrogen, an alkyl or hydroxyalkyl radical having up to 24 carbon atoms, a polyoxyalkylene radical $\text{-}(A\text{-}O)_r\text{—}$ or polyiminoalkylene radical $\text{-}[A\text{-}N(R^9)]_s\text{—}(R^9)$, but at least one $R^9$ is hydrogen, q is an integer from 1 to 19, A is an alkylene radical having 1 to 6 carbon atoms, r and s are each independently from 1 to 50. Typically, they are mixtures of polyamines and especially mixtures of poly(ethyleneamines) and/or poly(propyleneamines). Examples include: ethylenediamine, 1,2-propylenediamine, dimethylaminopropylamine, diethylenetriamine (DETA), dipropylenetriamine, triethylenetetramine (TETA), tripropylenetetramine, tetraethylenepentamine (TEPA), tetrapropylenepentamine, pentaethylenehexamine (PEHA) pentapropylenehexamine and heavy polyamines. Heavy polyamines are generally understood to mean mixtures of polyalkylenepolyamines which, in addition to small amounts of TEPA and PEHA, comprise mainly oligomers having 7 or more nitrogen atoms, of which two or more are in the form of primary amino groups. These polyamines often also contain structural elements branched via tertiary amino groups.

Further suitable amines are those which include cyclic structural units which derive from piperazine. The piperazine units may preferably have, on one or both nitrogen atoms, hydrogen, an alkyl or hydroxyalkyl radical having up to 24 carbon atoms or a polyiminoalkylene radical $-[A-N(R^9)]_s-(R^9)$ where A, $R^9$ and s are each as defined above.

Further suitable amines include alicyclic diamines such as 1,4-di(amino-methyl)cyclohexane and heterocyclic nitrogen compounds such as imidazolines and N-aminoalkylpiperazines, for example N-(2-aminoethyl)piperazine.

Detergent additives whose polar component derives from polyamines bearing hydroxyl groups, from polyamines substituted by heterocycles and from aromatic polyamines are also problematic. Examples include: N-(2-hydroxyethyl)ethylenediamine, $N,N^1$-bis(2-hydroxyethyl)ethylenediamine, N-(3-hydroxybutyl)tetra(methylene)diamine, N-2-aminoethylpiperazine, N-2- and N-3-aminopropylmorpholine, N-3-(dimethylamino)propylpiperazine, 2-heptyl-3-(2-aminopropyl)imidazoline, 1,4-bis(2-aminoethyl)piperazine, 1-(2-hydroxyethyl)piperazine, various isomers of phenylenediamine and of naphthalenediamine, and mixtures of these amines.

Particularly critical detergent additives for the cold additization of middle distillates are those based on heavy polyamines in which, in the above formula, $R^9$ is hydrogen and q assumes values of at least 3, especially at least 4, for example 5, 6 or 7. In the case of mixtures of different polyamines, a proportion of more than 10% by weight, particularly of more than 20% by weight and especially of more than 50% by weight of amines with q values of 4 or higher and especially with q values of 5 or higher and in particular with q values of 6 or higher in the total amount of amines used is considered to be particularly critical.

The oil-soluble alkyl radical and the polar head group of the detergent additives may be joined to one another either directly via a C—N bond or via an ester, amide or imide bond. Preferred detergent additives are accordingly alkylpoly(amines), Mannich reaction products, hydrocarbon-substituted succinamides and -imides, and mixtures of these substance classes.

The detergent additives joined via C—N bonds are preferably alkylpoly(amines) which are obtainable, for example, by reacting polyisobutylenes with polyamines, for example by hydroformylation and subsequent reductive amination with the abovementioned polyamines. One or more alkyl radicals may be bonded to the polyamine. Particularly critical detergent additives for cold additization are those based on higher polyamines having more than 4 nitrogen atoms, for example those having 5, 6 or 7 nitrogen atoms.

Detergent additives containing amide or imide bonds are obtainable, for example, by reacting alkenylsuccinic anhydrides with polyamines. Alkenylsuccinic anhydride and polyamine are reacted preferably in a molar ratio of about 1:0.5 to about 1:1. The parent alkenylsuccinic anhydrides are prepared typically by adding ethylenically unsaturated polyolefins or chlorinated polyolefins onto ethylenically unsaturated dicarboxylic acids.

For example, alkenylsuccinic anhydrides can be prepared by reacting chlorinated polyolefins with maleic anhydride. Alternatively, they can also be prepared by thermal addition of polyolefins to maleic anhydride in an "ene reaction". In this context, high-reactivity olefins having a high content of, for example, more than 75% and especially more than 85 mol %, based on the total number of polyolefin molecules, of isomers with terminal double bond are particularly suitable. The terminal double bonds may be either vinylidene double bonds $[-CH_2-C(=CH_2)-CH_3]$ or vinyl double bonds $[-CH=C(CH_3)_2]$.

For the preparation of alkenylsuccinic anhydrides, the molar ratio of the two reactants in the reaction between maleic anhydride and polyolefin can vary within wide limits. It may preferably be between 10:1 and 1:5, particular preference being given to molar ratios of 6:1 to 1:1. Maleic anhydride is used preferably in a stoichiometric excess, for example 1.1 to 3 mol of maleic anhydride per mole of polyolefin. Excess maleic anhydride can be removed from the reaction mixture, for example by distillation.

Since the reactants formed as primary products especially by ene reaction in turn contain an olefinic double bond, a further addition of unsaturated dicarboxylic acids with formation of so-called bismaleates is possible in a suitable reaction regime. The reaction products obtainable in this way have, based on the contents of the poly(olefins) reacted with unsaturated carboxylic acids, on average, a degree of maleation of more than 1, preferably about 1.01 to 2.0 and especially 1.1 to 1.8 dicarboxylic acid units per alkyl radical. Reaction with the abovementioned amines forms products which have significantly enhanced effectiveness as detergent additives. On the other hand, the impairment of the effectiveness of cold flow improvers also increases with increasing degree of maleation.

The reaction of alkenylsuccinic anhydrides with polyamines leads to products which may bear one or more amide and/or imide bonds per polyamine and, depending on the degree of maleation, one or two polyamines per alkyl radical. For the reaction, preference is given to using 1.0 to 1.7 and especially 1.1 to 1.5 mol of alkenylsuccinic anhydride per mole of polyamine, so that free primary amino groups remain in the product. In a further preferred embodiment, alkenylsuccinic anhydride and polyamine are reacted in equimolar amounts. The reaction of polyamines with alkenylsuccinic anhydrides having a high degree of acylation of 1.1 or more anhydride groups per alkyl radical, for example 1.3 or more anhydride groups per alkyl radical, also forms polymers which are particularly problematic for the response behavior of cold additives.

Typical and particularly preferred acylated nitrogen compounds are obtainable by reacting poly(isobutylene)-, poly(2-butenyl)-, poly(2-methyl-2-butenyl)-, poly(2,3-dimethyl-2-butenyl)- and poly(propenyl)succinic anhydrides having an average of about 1.2 to 1.5 anhydride groups per alkyl radical, whose alkylene radicals bear between 50 and 400 carbon atoms, with a mixture of poly(ethyleneamines) having about 3 to 7 nitrogen atoms and about 1 to 6 ethylene units.

Oil-soluble Mannich reaction products based on polyolefin-substituted phenols and polyamines also impair the effectiveness of conventional cold flow improvers.

Such Mannich bases can be prepared by known processes, for example by alkylation of phenol and/or salicylic acid with the above-described polyolefins, for example poly(isobutylene), poly(2-butene), poly(2-methyl-2-butene), poly(2,3-dimethyl-2-butene) or atactic poly(propylene) and subsequent condensation of the alkylphenol with aldehydes having 1 to 6 carbon atoms, for example formaldehyde or its reactive equivalents such as formalin or paraformaldehyde, and the above-described polyamines, for example TEPA, PEHA or heavy polyamines.

The mean molecular weight, determined by means of vapor pressure osmometry, of detergent additives which are particularly efficient but simultaneously also particularly critical for the cold additization of middle distillates is more than 800 g/mol and especially more than 2000 g/mol, for example more than 3000 g/mol. The mean molecular weight of the above-described detergent additives can also be increased by means of crosslinking reagents and adjusted to the end use.

Suitable crosslinking reagents are, for example, dialdehydes such as glutaraldehyde, bisepoxides, for example derived from bisphenol A, dicarboxylic acids and their reactive derivatives, for example maleic anhydride and alkenylsuccinic anhydrides, and higher polybasic carboxylic acids and derivatives thereof, for example trimellitic acid, trimellitic anhydride and pyromellitic dianhydride.

Preferred copolymers of ethylene B) which act as nucleators for paraffin crystallization contain preferably 4 to 10 mol %, more preferably 4.5 to 9 mol % and especially 5 to 7.9 mol % of structural units derived from at least one ethylenically unsaturated carboxylic ester. Suitable ethylenically unsaturated carboxylic esters are firstly esters of vinyl alcohol with $C_1$-$C_{20}$ carboxylic acids. In addition to vinyl acetate, esters of vinyl alcohol with $C_4$-$C_{14}$ carboxylic acids are especially preferred. Particular preference is given to esters of aliphatic carboxylic acids whose alkyl radicals or alkenyl radicals may be linear and especially branched. Among the branched alkyl radicals, preference is given especially to those whose branch is in the a position to the carboxyl group. Particular preference is given to neo-carboxylic acids whose alkyl radical is bonded to the carboxyl group by a tertiary carbon atom. Examples of suitable vinyl esters are vinyl acetate, vinyl propionate, vinyl butyrate, vinyl isobutyrate, vinyl pentanoate, vinyl pivalate, vinyl hexanoate, vinyl-n-octanoate, vinyl-2-ethylhexanoate, vinyl neononanoate, vinyl isodecanoate, vinyl neodecanoate, vinyl neoundecanoate and vinyl isotridecylate.

Equally suitable as ethylenically unsaturated carboxylic esters are esters of unsaturated carboxylic acids such as acrylic acid and methacrylic acid with $C_1$-$C_{20}$ alcohols and especially with $C_4$-$C_{14}$ alcohols. Preference is given to saturated linear and also branched fatty alcohols. Particularly suitable are esters of branched fatty alcohols, where the branch is preferably in the 2 position to the OH group. Examples of suitable ethylenically unsaturated carboxylic esters are methyl acrylate, ethyl acrylate, propyl acrylate, n-butyl acrylate, isobutyl acrylate, tert-butyl acrylate, 2-ethylhexyl acrylate, lauryl acrylate, and the corresponding esters of methacrylic acid.

In a particularly preferred embodiment, the copolymers B) which act as nucleators for paraffin crystallization, in addition to structural units derived from ethylene, contain structural units derived from at least two different ethylenically unsaturated carboxylic esters. Particularly useful copolymers have been found to be those which contain structural units derived from esters of vinyl alcohol with a $C_1$-$C_4$ carboxylic acid and esters of vinyl alcohol with a $C_5$-$C_{16}$ carboxylic acid. In turn, preference is given to the abovementioned branched carboxylic acids having 5 to 16 carbon atoms. Examples of such copolymers B) are terpolymers of ethylene, vinyl acetate and vinyl neononate, of ethylene, vinyl acetate and vinyl neodecanoate, of ethylene, vinyl acetate and vinyl neoundecanoate, and of ethylene, vinyl acetate and 2-ethylhexyl vinyl ester. Additionally useful copolymers have been found to be those which, in addition to structural units derived from ethylene, contain structural units derived from esters of vinyl alcohol with a $C_1$-$C_4$ carboxylic acid and esters of acrylic acid or methacrylic acid with $C_5$-$C_{20}$ alcohols. Examples of such copolymers B) are terpolymers of ethylene, vinyl acetate and 2-ethylhexyl acrylate, of ethylene, vinyl acetate and octyl acrylate, of ethylene, vinyl acetate and isotridecyl acrylate, and of ethylene, vinyl acetate and stearyl acrylate. The ratio of short-chain to long-chain ester may vary within wide ranges. It is preferably in a ratio between 1:10 and 10:1, especially between 1:5 and 5:1, for example between 1:3 and 3:1.

The copolymers of ethylene and ethylenically unsaturated carboxylic esters may further contain minor amounts of structural units which derive from lower olefins. Preferred olefins are especially those having 3 to 8 carbon atoms, such as propene, n-butene, isobutylene, pentene, hexene, 4-methylpentene and diisobutylene. Such terpolymers or higher polymers may contain up to 3 mol % of lower olefins, with the proviso that the total comonomer content is not more than 10.5 mol %, preferably not more than 9.0 and especially not more than 7.9 mol %.

The melt viscosity, measured at 140° C., of the solvent-free polymers is preferably between 100 and 5000 mPas, especially between 150 and 2000 mPas, for example between 200 and 1000 mPas.

The ratio between detergent additive A) and nucleators B) in the additized oil may vary within wide limits. It has been found to be particularly useful to use 0.01 to 10 parts by weight, especially 0.05 to 5 parts by weight, for example 0.1 to 3 parts by weight, of nucleator per part by weight of detergent additive, based in each case on the active ingredient.

Useful flow improvers C) which are used in the inventive middle distillates are especially one or more of the following substance classes III to VII, preference being given to using ethylene copolymers (constituent III) or mixtures thereof with one or more of constituents IV to VII. Particularly useful mixtures have been found to be those of ethylene copolymers (constituent III) and alkylphenol-aldehyde resins (constituent V), and of ethylene copolymers (constituent III) and comb polymers (constituent VI). For paraffin dispersancy, especially mixtures of ethylene copolymers (constituent III) with constituents IV and V or constituents IV and VI have been found to be useful.

Preferred cold flow improvers as constituent III are copolymers of ethylene and olefinically unsaturated compounds. Suitable ethylene copolymers are especially those which, in addition to ethylene, contain 8 to 21 mol %, especially 10 to 18 mol %, of olefinically unsaturated compounds as comonomers. However, in the case of combination with nucleators of group B), the comonomer content is at least 1 mol % higher and preferably at least 2 mol % higher than the nucleators of group B).

The olefinically unsaturated compounds are preferably vinyl esters, acrylic esters, methacrylic esters, alkyl vinyl ethers and/or alkenes, and the compounds mentioned may be substituted by hydroxyl groups. One or more comonomers may be present in the polymer.

The vinyl esters are preferably those of the formula 1

$$CH_2{=}CH{-}OCOR^1 \quad (1)$$

where $R^1$ is $C_1$- to $C_{30}$-alkyl, preferably $C_4$- to $C_{16}$-alkyl, especially $C_6$- to $C_{12}$-alkyl. In a further embodiment, the alkyl groups mentioned may be substituted by one or more hydroxyl groups.

In a further preferred embodiment, $R^1$ is a branched alkyl radical or a neoalkyl radical having 7 to 11 carbon atoms, especially having 8, 9 or 10 carbon atoms. Particularly preferred vinyl esters derive from secondary and especially tertiary carboxylic acids whose branch is in the alpha-position to the carbonyl group. Suitable vinyl esters include vinyl acetate, vinyl propionate, vinyl butyrate, vinyl isobutyrate, vinyl hexanoate, vinyl heptanoate, vinyl octanoate, vinyl pivalate, vinyl 2-ethylhexanoate, vinyl laurate, vinyl stearate and Versatic esters such as vinyl neononanoate, vinyl neodecanoate, vinyl neoundecanoate.

In a further preferred embodiment, these ethylene copolymers contain vinyl acetate and at least one further vinyl ester of the formula 1 where $R^1$ is $C_4$- to $C_{30}$-alkyl, preferably $C_4$- to $C_{16}$-alkyl, especially $C_6$- to $C_{12}$-alkyl.

The acrylic esters are preferably those of the formula 2

$$CH_2{=}CR^2{-}COOR^3 \quad (2)$$

where $R^2$ is hydrogen or methyl and $R^3$ is $C_1$- to $C_{30}$-alkyl, preferably $C_4$- to $C_{16}$-alkyl, especially $C_6$- to $C_{12}$-alkyl. Suitable acrylic esters include, for example, methyl(meth)acrylate, ethyl(meth)acrylate, propyl(meth)acrylate, n- and isobutyl(meth)acrylate, hexyl, octyl, 2-ethylhexyl, decyl, dodecyl, tetradecyl, hexadecyl, octadecyl(meth)acrylate and mixtures of these comonomers. In a further embodiment, the alkyl groups mentioned may be substituted by one or more hydroxyl groups. An example of such an acrylic ester is hydroxyethyl methacrylate.

The alkyl vinyl ethers are preferably compounds of the formula 3

$$CH_2{=}CH{-}OR^4 \quad (3)$$

where $R^4$ is $C_1$- to $C_{30}$-alkyl, preferably $C_4$- to $C_{16}$-alkyl, especially $C_6$- to $C_{12}$-alkyl. Examples include methyl vinyl ether, ethyl vinyl ether, isobutyl vinyl ether. In a further embodiment, the alkyl groups mentioned may be substituted by one or more hydroxyl groups.

The alkenes are preferably monounsaturated hydrocarbons having 3 to 30 carbon atoms, especially 4 to 16 carbon atoms and especially 5 to 12 carbon atoms. Suitable alkenes include propene, butene, isobutylene, pentene, hexene, 4-methylpentene, octene, diisobutylene and norbornene and derivatives thereof such as methylnorbornene and vinylnorbornene. In a further embodiment, the alkyl groups mentioned may be substituted by one or more hydroxyl groups.

Apart from ethylene, particularly preferred terpolymers contain 3.5 to 20 mol %, especially 8 to 15 mol %, of vinyl acetate, and 0.1 to 12 mol %, especially 0.2 to 5 mol %, of at least one relatively long-chain and preferably branched vinyl ester, for example vinyl 2-ethylhexanoate, vinyl neononanoate or vinyl neodecanoate, the total comonomer content of the terpolymers being preferably between 8 and 21 mol %, especially between 12 and 18 mol %. Further particularly preferred copolymers contain, in addition to ethylene and 8 to 18 mol % of vinyl esters of $C_2$- to $C_{12}$-carboxylic acids, also 0.5 to 10 mol % of olefins such as propene, butene, isobutylene, hexene, 4-methylpentene, octene, diisobutylene and/or norbornene.

These ethylene co- and terpolymers preferably have melt viscosities at 140° C. of 20 to 10 000 mPas, especially 30 to 5000 mPas, especially 50 to 2000 mPas. The degrees of branching determined by means of $^1H$ NMR spectroscopy are preferably between 1 and 9 $CH_3$/100 $CH_2$ groups, especially between 2 and 6 $CH_3$/100 $CH_2$ groups, which do not originate from the comonomers.

Preference is given to using mixtures of two or more of the abovementioned ethylene copolymers. More preferably, the polymers on which the mixtures are based differ in at least one characteristic. For example, they may contain different comonomers, or have different comonomer contents, molecular weights and/or degrees of branching.

The mixing ratio between the inventive additives and ethylene copolymers as constituent III may, depending on the application, vary within wide limits, the ethylene copolymers III often constituting the major proportion. Such additive and oil mixtures preferably contain 0.1 to 25, preferably 0.5 to 10, parts by weight of ethylene copolymers per part by weight of the inventive additive combination.

Further suitable cold flow improvers are oil-soluble polar nitrogen compounds (constituent IV). These are preferably reaction products of fatty amines with compounds which contain an acyl group. The preferred amines are compounds of the formula $NR^6R^7R^8$ in which $R^6$, $R^7$ and $R^8$ may be the same or different, and at least one of these groups is $C_8$-$C_{36}$-alkyl, $C_6$-$C_{36}$-cycloalkyl or $C_8$-$C_{36}$-alkenyl, especially $C_{12}$-$C_{24}$-alkyl, $C_{12}$-$C_{24}$-alkenyl or cyclohexyl, and the remaining groups are hydrogen, $C_1$-$C_{36}$-alkyl, $C_2$-$C_{36}$-alkenyl, cyclohexyl or a group of the formulae $-(A\text{-}O)_x\text{-}E$ or $—(CH_2)_n—NYZ$ in which A is an ethyl or propyl group, x is from 1 to 50, E=H, $C_1$-$C_{30}$-alkyl, $C_5$-$C_{12}$-cycloalkyl or $C_6$-$C_{30}$-aryl, and n=2, 3 or 4, and Y and Z are each independently H, $C_1$-$C_{30}$-alkyl or -(A-O). Polyamines of the formula $—[N—(CH_2)_m]_m—NR^6R^7$ in which m is from 1 to 20, and n, $R^6$ and $R^7$ are each as defined above, are also suitable as fatty amines. The alkyl and alkenyl radicals may each be linear or branched and contain up to two double bonds. They are preferably linear and substantially saturated, i.e. they have iodine numbers of less than 75 g of $I_2$/g, preferably less than 60 g of $I_2$/g and especially between 1 and 10 g of $I_2$/g. Particular preference is given to secondary fatty amines in which two of the $R^6$, $R^7$ and $R^8$ groups are each $C_8$-$C_{36}$-alkyl, $C_6$-$C_{36}$-cycloalkyl, $C_8$-$C_{36}$-alkenyl, especially $C_{12}$-$C_{24}$-alkyl, $C_{12}$-$C_{24}$-alkenyl or cyclohexyl. Suitable fatty amines are, for example, octylamine, decylamine, dodecylamine, tetradecylamine, hexadecylamine, octadecylamine, eicosylamine, behenylamine, didecylamine, didodecylamine, ditetradecylamine, dihexadecylamine, dioctadecylamine, dieicosylamine, dibehenylamine and mixtures thereof. The amines especially contain chain cuts based on natural raw materials, for example coconut fatty amine, tallow fatty amine, hydrogenated tallow fatty amine, dicoconut fatty amine, ditallow fatty amine and di(hydrogenated tallow fatty amine). Particularly preferred amine derivatives are amine salts, imides and/or amides, for example amide-ammonium salts of secondary fatty amines, especially of dicoconut fatty amine, ditallow fatty amine and distearylamine.

Acyl group is understood here to mean a functional group of the following formula:

$$>C{=}O$$

Carbonyl compounds suitable for the reaction with amines are either monomeric or polymeric compounds having one or more carboxyl groups. Preference is given to those monomeric carbonyl compounds having 2, 3 or 4 carbonyl groups. They may also contain heteroatoms such as oxygen, sulfur and nitrogen. Suitable carboxylic acids are, for example, maleic acid, fumaric acid, crotonic acid, itaconic acid, succinic acid, $C_1$-$C_{40}$-alkenylsuccinic acid, adipic acid, glutaric acid, sebacic acid and malonic acid, and also benzoic acid, phthalic acid, trimellitic acid and pyromellitic acid, nitrilotriacetic acid, ethylenediaminetetraacetic acid and their reactive derivatives, for example esters, anhydrides and acid halides. Useful polymeric carbonyl compounds have been found to be especially copolymers of ethylenically unsaturated acids, for example acrylic acid, methacrylic acid, maleic acid, fumaric acid and itaconic acid; particular preference is given to copolymers of maleic anhydride. Suitable comonomers are those which impart oil solubility to the copolymer. Oil-soluble means here that the copolymer, after reaction with the fatty amine, dissolves without residue in the middle distillate to be additized in practically relevant dosages. Suitable comonomers are, for example, olefins, alkyl esters of acrylic acid and methacrylic acid, alkyl vinyl esters and alkyl vinyl ethers having 2 to 75, preferably 4 to 40 and especially 8 to 20 carbon atoms in the alkyl radical. In the case of olefins, the carbon number is based on the alkyl radical attached to the double bond. The molecular weights of the polymeric carbonyl compounds are preferably between 400 and 20 000, more preferably between 500 and 10 000, for example between 1000 and 5000.

It has been found that particularly useful oil-soluble polar nitrogen compounds are those which are obtained by reaction of aliphatic or aromatic amines, preferably long-chain aliphatic amines, with aliphatic or aromatic mono-, di-, tri- or tetracarboxylic acids or their anhydrides (cf. U.S. Pat. No. 4,211,534). Equally suitable as oil-soluble polar nitrogen compounds are amides and ammonium salts of aminoalkylenepolycarboxylic acids such as nitrilotriacetic acid or ethylenediamine-tetraacetic acid with secondary amines (cf. EP 0 398 101). Other oil-soluble polar nitrogen compounds are copolymers of maleic anhydride and α,β-unsaturated compounds which may optionally be reacted with primary monoalkylamines and/or aliphatic alcohols (cf. EP-A-0 154 177, EP 0 777 712), the reaction products of alkenyl-spirobislactones with amines (cf. EP-A-0 413 279 B1) and, according to EP-A-0 606 055 A2, reaction products of terpolymers based on α,β-unsaturated dicarboxylic anhydrides, a,p-unsaturated compounds and polyoxyalkylene ethers of lower unsaturated alcohols.

The mixing ratio between the inventive ethylene copolymers III and oil-soluble polar nitrogen compounds as constituent IV may vary depending upon the application. Such additive mixtures preferably contain, based on the active ingredients, 0.1 to 10 parts by weight, preferably 0.2 to 5 parts by weight, of at least one oil-soluble polar nitrogen compound per part by weight of the inventive additive combination.

Also suitable as flow improvers are alkylphenol-aldehyde resins as constituent V.

These are especially those alkylphenol-aldehyde resins which derive from alkylphenols having one or two alkyl radicals in ortho and/or para positions to the OH group. Particularly preferred starting materials are alkylphenols which bear, on the aromatic, at least two hydrogen atoms capable of condensation with aldehydes, and especially monoalkylated phenols. The alkyl radical is more preferably in the para-position to the phenolic OH group. The alkyl radicals (for constituent V, this refers generally to hydrocarbon radicals as defined below) may be the same or different in the alkylphenol-aldehyde resins usable in the process according to the invention, they may be saturated or unsaturated and have preferably 1-20, especially 4-16, for example 6-12, carbon atoms; they are preferably n-, iso- and tert-butyl, n- and isopentyl, n- and isohexyl, n- and isooctyl, n- and isononyl, n- and isodecyl, n- and isododecyl, tetradecyl, hexadecyl, octadecyl, tripropenyl, tetrapropenyl, poly(propenyl) and poly (isobutenyl) radicals. In a preferred embodiment, the alkylphenol resins are prepared by using mixtures of alkylphenols with different alkyl radicals. For example, resins based firstly on butylphenol and secondly on octyl-, nonyl- and/or dodecylphenol in a molar ratio of 1:10 to 10:1 have been found to be particularly useful.

Suitable alkylphenol resins may also contain or consist of structural units of further phenol analogs such as salicylic acid, hydroxybenzoic acid and derivatives thereof, such as esters, amides and salts.

Suitable aldehydes for the alkylphenol-aldehyde resins are those having 1 to 12 carbon atoms and preferably having 1 to 4 carbon atoms, for example formaldehyde, acetaldehyde, propionaldehyde, butyraldehyde, 2-ethylhexanal, benzaldehyde, glyoxalic acid and their reactive equivalents such as paraformaldehyde and trioxane. Particular preference is given to formaldehyde in the form of paraformaldehyde and especially formalin.

The molecular weight of the alkylphenol-aldehyde resins, measured by means of gel permeation chromatography against poly(styrene) standards in THF, is preferably 500-25 000 g/mol, more preferably 800-10 000 g/mol and especially 1000-5000 g/mol, for example 1500-3000 g/mol. A prerequisite here is that the alkylphenol-aldehyde resins are oil-soluble at least in concentrations relevant to use of 0.001 to 1% by weight.

In a preferred embodiment of the invention, they are alkylphenol-formaldehyde resins which contain oligo- or polymers with a repeat structural unit of the formula

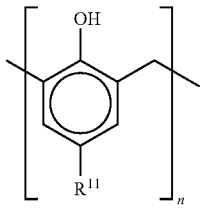

where $R^{11}$ is $C_1$-$C_{20}$-alkyl or -alkenyl, O—$R^{10}$ or O—C(O)—$R^{10}$, $R^{10}$ is $C_1$-$C_{200}$-alkyl or -alkenyl and n is from 2 to 100. $R^{10}$ is preferably $C_1$-$C_{20}$-alkyl or -alkenyl and especially $C_4$-$C_{16}$-alkyl or -alkenyl, for example $C_6$-$C_{12}$-alkyl or -alkenyl. $R^{11}$ is more preferably $C_1$-$C_{20}$-alkyl or -alkenyl and especially $C_4$-$C_{16}$-alkyl or -alkenyl, for example $C_6$-$C_{12}$-alkyl or -alkenyl. n is preferably from 2 to 50 and especially from 3 to 25, for example from 5 to 15.

These alkylphenol-aldehyde resins are obtainable by known processes, for example by condensation of the corresponding alkylphenols with formaldehyde, i.e. with 0.5 to 1.5 mol, preferably 0.8 to 1.2 mol, of formaldehyde per mole of alkylphenol. The condensation can be effected without solvent, but is preferably effected in the presence of a water-immiscible or only partly water-miscible inert organic solvent, such as mineral oils, alcohols, ethers and the like. Particular preference is given to solvents which can form azeotropes with water. The solvents of this type used are especially aromatics such as toluene, xylene, diethylbenzene, and higher-boiling commercial solvent mixtures such as Shellsol® AB and Solvent Naphtha. Also suitable as solvents are fatty acids and derivatives thereof, for example esters with lower alcohols having 1 to 5 carbon atoms, for example ethanol and especially methanol. The condensation is effected preferably between 70 and 200° C., for example between 90 and 160° C. It is typically catalyzed by 0.05 to 5% by weight of bases or preferably by 0.05 to 5% by weight of acids. Catalysts useful as acidic catalysts are, in addition to carboxylic acids such as acetic acid and oxalic acid, especially strong mineral acids such as hydrochloric acid, phosphoric acid and sulfuric acid, and also sulfonic acids. Particularly suitable catalysts are sulfonic acids which contain at least one sulfonic acid group and at least one saturated or unsaturated, linear, branched and/or cyclic hydrocarbon radical having 1 to 40 carbon atoms and preferably having 3 to 24 carbon atoms. Particular preference is given to aromatic sulfonic acids, especially alkylaromatic monosulfonic acids having one or more $C_1$-$C_{28}$-alkyl radicals and especially those having $C_3$-$C_{22}$-alkyl radicals. Suitable examples are methanesulfonic acid, butanesulfonic acid, benzenesulfonic acid, p-toluenesulfonic acid, xylenesulfonic acid, 2-mesitylenesulfonic acid, 4-ethylbenzenesulfonic acid, isopropylbenzenesulfonic acid, 4-butylbenzenesulfonic acid, 4-octylbenzenesulfonic acid, dodecylbenzenesulfonic acid, didodecylbenzenesulfonic acid, naphthalenesulfonic acid. Mixtures of these sulfonic acids are also suitable. Typically, they remain in the product as such or in neutralized form after the reaction has ended. Preference is given to using amines and/or aromatic bases for neutralization, since they can remain in the product; salts which contain metal ions and hence form ash are typically removed.

Comb polymers likewise suitable as flow improvers (constituent VI) can be described, for example, by the formula

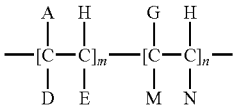

In this formula,

| | |
|---|---|
| A | is R', COOR', OCOR', R"—COOR', OR'; |
| D | is H, $CH_3$, A or R"; |
| E | is H, A; |
| G | is H, R", R"—COOR', an aryl radical or a heterocyclic radical; |
| M | is H, COOR", OCOR", OR", COOH; |
| N | is H, R", COOR", OCOR, an aryl radical; |
| R' | is a hydrocarbon chain having 8 to 20, preferably 10 to 18, carbon atoms; |
| R" | is a hydrocarbon chain having 1 to 10 carbon atoms; |
| m | is from 0.4 to 1.0; and |
| n | is from 0 to 0.6. |

Suitable comb polymers are, for example, copolymers of ethylenically unsaturated dicarboxylic acids, such as maleic acid or fumaric acid, with other ethylenically unsaturated monomers, such as olefins or vinyl esters, for example vinyl acetate. Particularly suitable olefins in this context are α-olefins having 10 to 20 and especially 12 to 18 carbon atoms, for example 1-decene, 1-dodecene, 1-tetradecene, 1-hexadecene, 1-octadecene and mixtures thereof. Longer-chain olefins based on oligomerized $C_2$-$C_6$-olefins, for example poly(isobutylene) having a high content of terminal double bonds, are also suitable as comonomers. Typically, these copolymers are esterified to an extent of at least 50% with alcohols having 10 to 20 and especially 12 to 18 carbon atoms. Suitable alcohols include n-decan-1-ol, n-dodecan-1-ol, n-tetradecan-1-ol, n-hexadecan-1-ol, n-octadecan-1-ol and mixtures thereof. Particular preference is given to mixtures of n-tetradecan-1-ol and n-hexadecan-1-ol. Likewise suitable as comb polymers are poly(alkyl acrylates), poly(alkyl methacrylates) and poly(alkyl vinyl ethers) which derive from alcohols having 10 to 20 and especially 12 to 18 carbon atoms, and poly(vinyl esters) which derive from fatty acids having 10 to 20 and especially 12 to 18 carbon atoms.

Additionally suitable as flow improvers are oil-soluble polyoxyalkylene compounds (constituent VII), for example esters, ethers and ether/esters of polyols, which bear at least one alkyl radical having 12 to 30 carbon atoms. In a preferred embodiment, the oil-soluble polyoxyalkylene compounds possess at least 2, for example 3, 4 or 5, aliphatic hydrocarbon radicals. These radicals preferably independently possess 16 to 26 carbon atoms, for example 17 to 24 carbon atoms. These radicals of the oil-soluble polyoxyalkylene compounds are preferably linear. Additionally preferably, they are very substantially saturated, and are especially alkyl radicals. Esters are particularly preferred.

Polyols which are particularly suitable in accordance with the invention are polyethylene glycols, polypropylene glycols, polybutylene glycols and copolymers thereof with a molecular weight of approx. 100 to approx. 5000 g/mol, preferably 200 to 2000 g/mol. In a particularly preferred embodiment, the oil-soluble polyoxyalkylene compounds derive from polyols having 3 or more OH groups, preferably from polyols having 3 to about 50 OH groups, for example 4 to 10 OH groups, especially from neopentyl glycol, glycerol, trimethylolethane, trimethylolpropane, sorbitan, pentaerythritol, and the oligomers which are obtainable therefrom by condensation and have 2 to 10 monomer units, for example polyglycerol. Also suitable as polyols are higher polyols, for example sorbitol, sucrose, glucose, fructose and oligomers thereof, for example cyclodextrin, provided that the esterified or etherified alkoxylates thereof are oil-soluble at least in application-relevant amounts. Preferred polyoxyalkylene compounds thus have a branched polyoxyalkylene core to which a plurality of alkyl radicals which impart oil solubility are bonded.

The polyols are generally reacted with 3 to 70 mol of alkylene oxide, preferably 4 to 50 mol and especially 5 to 20 mol of alkylene oxide per hydroxyl group of the polyol. Preferred alkylene oxides are ethylene oxide, propylene oxide and/or butylene oxide. The alkoxylation is effected by known processes.

The fatty acids suitable for the esterification of the alkoxylated polyols have preferably 12 to 30 and especially 16 to 26 carbon atoms. Suitable fatty acids are, for example, lauric acid, tridecanoic acid, myristic acid, pentadecanoic acid, palmitic acid, margaric acid, stearic acid, isostearic acid, arachic acid and behenic acid, oleic acid and erucic acid, palmitoleic acid, myristoleic acid, ricinoleic acid, and fatty acid mixtures obtained from natural fats and oils. Preferred fatty acid mixtures contain more than 50 mol % of fatty acids having at least 20 carbon atoms. Preferably less than 50 mol % of the fatty acids used for esterification contain double bonds, particularly less than 10 mol %; they are especially very substantially saturated. The esterification may also proceed from reactive derivatives of the fatty acids, such as esters with lower alcohols (e.g. methyl or ethyl esters) or anhydrides.

In the context of the present invention, "very substantially saturated" is understood to mean an iodine number of the fatty acid used or of the fatty alcohol used of up to 5 g of I per 100 g of fatty acid or fatty alcohol.

For esterification of the alkoxylated polyols, it is also possible to use mixtures of the above fatty acids with fat-soluble polybasic carboxylic acids. Examples of suitable polybasic carboxylic acids are dimer fatty acids, alkenylsuccinic acids and aromatic polycarboxylic acids, and derivatives thereof such as anhydrides and $C_1$ to $C_5$ esters. Preference is given to alkenylsuccinic acid and derivatives thereof with alkyl radicals having 8 to 200 and especially 10 to 50 carbon atoms. Examples are dodecenyl-, octadecenyl- and poly(isobutenyl) succinic anhydride. The polybasic carboxylic acids are preferably used in minor proportions of up to 30 mol %, preferably 1 to 20 mol %, especially 2 to 10 mol %.

Ester and fatty acid are used for the esterification, based on the content of hydroxyl groups on the one hand and carboxyl groups on the other hand, in a ratio of 1.5:1 to 1:1.5, preferably in a ratio of 1.1:1 to 1:1.1 and especially in equimolar amounts. The acid number of the esters formed is generally less than 15 mg KOH/g, preferably less than 10 mg KOH/g, especially less than 5 mg KOH/g. The OH number of the esters is preferably less than 20 mg KOH/g and especially less than 10 mg KOH/g.

In a preferred embodiment, after the alkoxylation of the polyol, the terminal hydroxyl groups are converted to terminal carboxyl groups, for example by oxidation or by reaction with dicarboxylic acids. Reaction with fatty alcohols having 8 to 50, particularly 12 to 30 and especially 16 to 26 carbon atoms likewise affords inventive polyoxyalkylene esters. Preferred fatty alcohols or fatty alcohol mixtures contain more than 50 mol % of fatty alcohols having at least 20 carbon atoms.

Preferably less than 50 mol % of the fatty alcohols used for esterification contain double bonds, particularly less than 10 mol %; they are especially very substantially saturated. Esters of alkoxylated fatty alcohols with fatty acids, which contain abovementioned proportions of poly(alkylene oxides) and whose fatty alcohol and fatty acid possess abovementioned alkyl chain lengths and degrees of saturation, are also suitable in accordance with the invention.

In addition, the above-described alkoxylated polyols can be converted to polyoxyalkylene compounds suitable in accordance with the invention by etherification with fatty alcohols having 8 to 50, particularly 12 to 30 and especially 16 to 26 carbon atoms. The fatty alcohols preferred for this purpose are linear and very substantially saturated. The etherification is preferably effected completely or at least very substantially completely. The etherification is performed by known processes.

Particularly preferred polyoxyalkylene compounds derive from polyols having 3, 4 and 5 OH groups, which bear about 5 to 10 mol of structural units derived from ethylene oxide per hydroxyl group of the polyol and are very substantially completely esterified with very substantially saturated $C_{17}$-$C_{24}$ fatty acids. Further particularly preferred polyoxyalkylene compounds are polyethylene glycols which have been esterified with very substantially saturated $C_{17}$-$C_{24}$ fatty acids and have molecular weights of about 350 to 1000 g/mol. Examples of particularly suitable polyoxyalkylene compounds are polyethylene glycols which have been esterified with stearic acid and especially behenic acid and have molecular weights between 350 and 800 g/mol; neopentyl glycol 14-ethylene oxide distearate (neopentyl glycol which has been alkoxylated with 14 mol of ethylene oxide and then esterified with 2 mol of stearic acid) and especially neopentyl glycol 14-ethylene oxide dibehenate; glycerol 20-ethylene oxide tristearate, glycerol 20-ethylene oxide dibehenate and especially glycerol 20-ethylene oxide tribehenate; trimethylolpropane 22-ethylene oxide tribehenate; sorbitan 25-ethylene oxide tristearate, sorbitan 25-ethylene oxide tetrastearate, sorbitan 25-ethylene oxide tribehenate and especially sorbitan 25-ethylene oxide tetrabehenate; pentaerythritol 30-ethylene oxide tribehenate, pentaerythritol 30-ethylene oxide tetrastearate and especially pentaerythritol 30-ethylene oxide tetrabehenate and pentaerythritol 20-ethylene oxide 10-propylene oxide tetrabehenate.

The mixing ratio between the inventive additives and the further constituents V, VI and VII is generally in each case between 1:10 and 10:1, preferably between 1:5 and 5:1.

Inventive additives comprising only detergent additive A) and nucleator B) contain preferably 10-90% by weight and especially 20-80% by weight, for example 30-70% by weight, of detergent additive A) and 10-90% by weight and especially 20-80% by weight, for example 30-70% by weight, of nucleator B). When a further cold flow improver C) is also present, the additives contain preferably 15-80% by weight, preferably 20-70% by weight, of detergent additive A), 2-40% by weight, preferably 5-25% by weight, of nucleator B) and 15-80% by weight, preferably between 20-70% by weight, of cold flow improver C).

For the purpose of simpler handling, the inventive additives are preferably used in the form of concentrates which contain 10 to 95% by weight and preferably 20 to 80% by weight, for example 25 to 60% by weight, of solvent. Preferred solvents are relatively high-boiling aliphatic, aromatic hydrocarbons, alcohols, esters, ethers and mixtures thereof. Such concentrates preferably contain 0.01 to 10 parts by weight, preferably 0.05 to 5 parts by weight, for example 0.1 to 3 parts by weight, of the compound B) which acts as a nucleator per part by weight of detergent additive A).

The inventive nucleators B) improve the response behavior of middle distillates comprising detergent additive, such as kerosene, jet fuel, diesel and heating oil for conventional flow improvers with regard to the lowering of pour point and CFPP value and the improvement of the paraffin dispersancy.

Particularly preferred mineral oil distillates are middle distillates. Middle distillates refer especially to those mineral oils which are obtained by distilling crude oil and boil within the range from about 150 to 450° C. and especially within the range from about 170 to 390° C., for example kerosene, jet fuel, diesel oil and heating oil. Typically, middle distillates contain about 5 to 50% by weight, for example about 10 to 35% by weight, of n-paraffins, among which the relatively long-chain n-paraffins crystallize out in the course of cooling and can impair the flowability of the middle distillate. The inventive compositions are particularly advantageous in middle distillates with low aromatics content of less than 21% by weight, for example less than 19% by weight. The inventive compositions are also particularly advantageous in middle distillates with low final boiling point, i.e. in those middle distillates which have 90% distillation points below 360° C., especially 350° C. and in special cases below 340° C., and additionally in those middle distillates which have boiling ranges between 20 and 90% distillation volumes of less than 120° C. and especially of less than 110° C. Aromatic compounds are understood to mean the sum of mono-, di- and polycyclic aromatic compounds, as can be determined by means of HPLC to DIN EN 12916 (2001 edition). The middle distillates may also contain minor amounts, for example up to 40% by volume, preferably 1 to 20% by volume, especially 2 to 15% by volume, for example 3 to 10% by volume, of the oils of animal and/or vegetable origin described in detail below, for example fatty acid methyl esters.

The inventive compositions are likewise suitable for improving the cold properties of fuels which comprise detergent additives and are based on renewable raw materials (biofuels). Biofuels are understood to mean oils which are obtained from animal material and preferably from vegetable material or both, and derivatives thereof, which can be used as a fuel and especially as a diesel or heating oil. They are especially triglycerides of fatty acids having 10 to 24 carbon atoms, and also the fatty acid esters of lower alcohols, such as methanol or ethanol, obtainable from them by transesterification.

Examples of suitable biofuels are rapeseed oil, coriander oil, soybean oil, cottonseed oil, sunflower oil, castor oil, olive oil, groundnut oil, corn oil, almond oil, palm kernel oil, coconut oil, mustard seed oil, bovine tallow, bone oil, fish oils and used cooking oils. Further examples include oils which derive from wheat, jute, sesame, shea tree nut, arachis oil and linseed oil. The fatty acid alkyl esters also known as biodiesel can be derived from these oils by processes known in the prior art. Rapeseed oil, which is a mixture of fatty acids esterified with glycerol, is preferred, since it is obtainable in large amounts and is obtainable in a simple manner by extractive pressing of rapeseed. Preference is further given to the likewise widespread oils of sunflowers, palms and soya, and mixtures thereof with rapeseed oil.

Particularly suitable biofuels are lower alkyl esters of fatty acids. Useful examples here are commercial mixtures of the ethyl esters, propyl esters, butyl esters and especially methyl esters of fatty acids having 14 to 22 carbon atoms, for example of lauric acid, myristic acid, palmitic acid, palmitoleic acid, stearic acid, oleic acid, elaidic acid, petroselic acid, ricinoleic acid, eleostearic acid, linoleic acid, linolenic acid, eicosanoic acid, gadoleic acid, docosanoic acid or erucic acid. Preferred esters have an iodine number of 50 to 150 and especially of 90 to 125. Mixtures with particularly advantageous properties are those which contain mainly, i.e. to an extent of at least 50% by weight, methyl esters of fatty acids having 16 to 22 carbon atoms and 1, 2 or 3 double bonds. The preferred lower alkyl esters of fatty acids are the methyl esters of oleic acid, linoleic acid, linolenic acid and erucic acid.

The additives may be used alone or else together with other additives, for example with other pour point depressants or dewaxing assistants, with other detergents, with antioxidants, cetane number improvers, dehazers, demulsifiers, dispersants, antifoams, dyes, corrosion inhibitors, lubricity additives, sludge inhibitors, odorants and/or additives for lowering the cloud point.

EXAMPLES

Improvement in the Cold Flowability of Middle Distillates

To assess the effect of the inventive additives on the cold flow properties of middle distillates, detergent additives (A) were used with various nucleators (B) and further flow improvers (C) with the characteristics specified below.

The suppression of the adverse effect of the detergent additives on known cold flow improvers for mineral oils and mineral oil distillates by nucleators is described firstly with the aid of the CFPP test (Cold Filter Plugging Test to EN 116).

In addition, the paraffin dispersancy in middle distillates is determined as follows in the brief sedimentation test:

150 ml of the middle distillates admixed with the additive components specified in the table were cooled in 200 ml measuring cylinders to −13° C. at −2° C./hour in a cold cabinet, and stored at this temperature for 16 hours. Subsequently, volume and appearance both of the sedimented paraffin phase and of the supernatant oil phase are determined and assessed visually. A small amount of sediment and an opaque oil phase show good paraffin dispersancy.

In addition, directly after the cold storage, the lower 20% by volume are isolated and the cloud point is determined to IP 3015. An only low deviation of the cloud point of the lower phase ($CP_{cc}$) from the blank value of the oil shows good paraffin dispersancy.

Table 1: Characterization of the Test Oils:

The test oils employed were current middle distillates from European refineries. The CFPP value was determined to EN 116 and the cloud point to ISO 3015. The aromatic hydrocarbon groups were determined to DIN EN 12916 (November 2001 edition).

| | | Test oil 1 | Test oil 2 | Test oil 3 |
|---|---|---|---|---|
| Distillation | | | | |
| IBP | [° C.] | 192 | 186 | 165 |
| 20% | [° C.] | 250 | 222 | 228 |
| 90% | [° C.] | 322 | 324 | 335 |
| (90-20)% | [° C.] | 72 | 102 | 107 |
| FBP | [° C.] | 347 | 352 | 359 |
| Cloud Point | [° C.] | −8.0 | −8.9 | −4.4 |
| CFPP | [° C.] | −10 | −10 | −5 |
| Density @15° C. | [g/cm$^3$] | 0.835 | 0.8307 | 0.8273 |
| Sulfur content | [ppm] | <10 | <10 | 15 |

-continued

| | | Test oil 1 | Test oil 2 | Test oil 3 |
|---|---|---|---|---|
| Aromatics content | [% by wt.] | 19.6 | 18.8 | 22.8 |
| of which mono | [% by wt.] | 18.0 | 18.2 | 20.6 |
| di | [% by wt.] | 1.6 | 0.6 | 2.1 |
| poly | [% by wt.] | <0.1 | <0.1 | 0.1 |

The following additives were used:

(A) Characterization of the Detergent Additives Used

The detergent additives A used were various reaction products, listed in Table 2, of alkenylsuccinic anhydrides (ASA) based on high-reactivity polyolefins (content of terminal double bonds >90%; degree of maleation about 1.2 to 1.3) with polyamines. To this end, alkenylsuccinic anhydride and polyamine were reacted in a molar ratio of 1.0 to 1.5 mol of alkenylsuccinic anhydride per mole of polyamine (see Table 2). For better dosability, the detergent additives were used in the form of 33% solutions in relatively high-boiling aromatic solvent. The dosages specified in Tables 2 to 4 for the detergent additives A) and nucleators B) are, however, based on the active ingredients used.

(B) Characterization of the Nucleators Used

B1) Copolymer of ethylene and 9.3 mol % of vinyl acetate, 50% in relatively high-boiling aromatic solvent.

B2) Copolymer of ethylene and 1 mol % of vinyl neodecanoate, 50% in relatively high-boiling aromatic solvent.

B3) Terpolymer of ethylene, 3.2 mol % of vinyl acetate and 4.5 mol % of 2-ethylhexyl acrylate, 50% in relatively high-boiling aromatic solvent.

(C) Characterization of the further flow improvers

C1) Terpolymer of ethylene, 13 mol % of vinyl acetate and 2 mol % of vinyl neodecanoate having a melt viscosity V140 measured at 140° C. of 95 mPas, 65% in kerosene.

C2) Mixture of equal parts of C1) and a copolymer of ethylene and 13.5 mol % of vinyl acetate having a melt viscosity V140 measured at 140° C. of 125 mPas, 56% in kerosene.

C3) Mixture of 2 parts of reaction product of a copolymer of C14/C16-α-olefin and maleic anhydride with 2 equivalents of hydrogenated ditallow fat amine with one part of nonylphenol-formaldehyde resin, 50% in relatively high-boiling aromatic solvent.

C4) Reaction product of ethylenediaminetetraacetic acid with 4 equivalents of ditallow fatty amine to give the amide-ammonium salt, prepared according to EP 0 398 101, 50% in relatively high-boiling aromatic solvent.

C5) Mixture of equal parts of a reaction product of phthalic anhydride and 2 equivalents of di(hydrogenated tallow fat) amine with a copolymer of ditetradecyl fumarate, 50% in relatively high-boiling aromatic solvent.

The CFPP values in test oil 1 were determined after the oil had been additized with 200 ppm of C2 and 150 ppm of C3.

In the examples of tables 3 and 4, the detergent additive A1 used was the reaction product of poly(isobutenyl)succinic anhydride and pentaethylenehexamine according to table 2 example 4, and the detergent additive A2 used was the reaction product of poly(isobutenyl)succinic anhydride and pentaethylene-hexamine according to table 2 example 13.

TABLE 2

Effect of nucleators on the antagonism caused by detergent additives in test oil 1

| | Detergent additive (DA) | | | | | CFPP in test oil 1 [° C.] | | | |
|---|---|---|---|---|---|---|---|---|---|
| Example | polyolefin | Mw of polyolefin | polyamine | mol of ASA/mol of polyamine | dosage DA/ppm | without DA | with DA | with DA + nucleator | |
| 1 | PIB | 700 | TEPA | 1.0 | 150 | −29 | −25 | 50 ppm B2 | −29 |
| 2 | PIB | 700 | TEPA | 1.4 | 150 | −29 | −26 | 50 ppm B2 | −30 |
| 3 | PIB | 1000 | PEHA | 1.0 | 150 | −29 | −22 | 75 ppm B1 | −28 |
| 4 | PIB | 1000 | PEHA | 1.5 | 150 | −29 | −21 | 75 ppm B3 | −29 |
| 5 | PIB | 1000 | PAM | 1.0 | 150 | −29 | −18 | 50 ppm B2 | −27 |
| 6 | PIB | 1000 | PAM | 1.3 | 150 | −29 | −15 | 50 ppm B2 | −29 |
| 7 | PIB | 1000 | PAM | 1.3 | 150 | −29 | −15 | 75 ppm B2 | −30 |
| 8 | PIB | 1000 | PAM | 1.3 | 150 | −29 | −15 | 100 ppm B2 | −29 |
| 9 | APP | 1150 | PEHA | 1.5 | 150 | −29 | −26 | 50 ppm B1 | −30 |
| 10 | APP | 1150 | PAM | 1.0 | 150 | −29 | −20 | 50 ppm B1 | −29 |
| 11 | APP | 1150 | PAM | 1.5 | 150 | −29 | −20 | 50 ppm B2 | −28 |
| 12 | P2B | 1000 | PAM | 1.1 | 150 | −29 | −11 | 50 ppm B3 | −29 |
| 13 | P2B | 1000 | PAM | 1.4 | 150 | −29 | −14 | 50 ppm B3 | −28 |

DA = detergent additive;
PIB = poly(isobutylene);
APP = atactic poly(propylene);
P2B = poly(butene) formed from mixture of different butene isomers with a proportion of 2-butene of approx. 80%;
TEPA = tetraethylenepentamine;
PEHA = pentaethylenehexamine;
PAM = heavy polyamine

TABLE 3

Cold flow improvement in test oil 2

| | Additives | | | | Test oil 2 CFPP |
|---|---|---|---|---|---|
| Example | A | B | C | | [° C.] |
| 14 (comp.) | — | — | 75 ppm C2 | — | −14 |
| 15 (comp.) | — | — | 100 ppm C2 | — | −19 |
| 16 (comp.) | — | — | 150 ppm C1 | — | −20 |
| 17 (comp.) | — | — | 75 ppm C1 | 150 ppm C3 | −21 |
| 18 (comp.) | — | — | 100 ppm C1 | 150 ppm C3 | −29 |
| 19 (comp.) | — | — | 150 ppm C1 | 150 ppm C3 | −31 |
| 20 (comp.) | 50 ppm A1 | — | 75 ppm C1 | 150 ppm C3 | −14 |
| 21 (comp.) | 50 ppm A1 | — | 100 ppm C1 | 150 ppm C3 | −19 |
| 22 (comp.) | 50 ppm A1 | — | 150 ppm C1 | 150 ppm C3 | −20 |
| 23 (comp.) | 50 ppm A1 | — | 150 ppm C1 | 250 ppm C3 | −20 |
| 24 | 50 ppm A1 | 25 ppm B2 | 75 ppm C1 | 150 ppm C3 | −20 |
| 25 | 50 ppm A1 | 25 ppm B2 | 100 ppm C1 | 150 ppm C3 | −30 |
| 26 | 50 ppm A1 | 25 ppm B1 | 100 ppm C1 | 150 ppm C3 | −28 |
| 27 (comp.) | 50 ppm A2 | — | 75 ppm C1 | 150 ppm C4 | −15 |
| 28 (comp.) | 50 ppm A2 | — | 100 ppm C1 | 150 ppm C4 | −12 |
| 29 (comp.) | 50 ppm A2 | — | 150 ppm C1 | 150 ppm C4 | −20 |
| 30 (comp.) | 50 ppm A2 | — | 150 ppm C1 | 250 ppm C4 | −21 |
| 31 | 50 ppm A2 | 25 ppm B2 | 75 ppm C1 | 150 ppm C4 | −21 |
| 32 | 50 ppm A2 | 25 ppm B2 | 100 ppm C1 | 150 ppm C4 | −27 |
| 33 | 50 ppm A2 | 25 ppm B3 | 75 ppm C1 | 150 ppm C4 | −19 |
| 34 | 50 ppm A2 | 25 ppm B3 | 100 ppm C1 | 150 ppm C4 | −26 |

TABLE 4

Cold flow improvement in test oil 3

| | Additives [ppm] | | | | Test oil 3 (CP −4.4° C.) | | | |
|---|---|---|---|---|---|---|---|---|
| | | | | | CFPP | Sediment | Oil phase | $CP_{CC}$ |
| Example | A | B | C | D | [° C.] | [% by vol.] | appearance | [° C.] |
| 35 (comp.) | — | — | 400 C2 | 200 C3 | −20 | 2 | opaque | −3.1 |
| 36 (comp.) | — | — | 535 C2 | 265 C3 | −22 | 2 | opaque | −3.2 |
| 37 (comp.) | 70 A2 | — | 400 C2 | 200 C3 | −15 | 25 | cloudy | 0.5 |
| 38 (comp.) | 70 A2 | — | 535 C2 | 265 C3 | −17 | 20 | cloudy | −0.5 |
| 39 | 70 A2 | 40 B1 | 400 C2 | 200 C3 | −20 | 3 | opaque | −2.9 |
| 40 | 70 A2 | 40 B1 | 535 C2 | 265 C3 | −23 | 2 | opaque | −3.1 |
| 41 | 70 A2 | 25 B2 | 400 C2 | 200 C3 | −19 | 3 | opaque | −2.8 |

TABLE 4-continued

| Cold flow improvement in test oil 3 | | | | | | | | |
|---|---|---|---|---|---|---|---|---|
| | | | | | Test oil 3 (CP −4.4° C.) | | | |
| | Additives [ppm] | | | | CFPP | Sediment | Oil phase | $CP_{CC}$ |
| Example | A | B | C | D | [° C.] | [% by vol.] | appearance | [° C.] |
| 42 | 70 A2 | 25 B2 | 535 C2 | 265 C3 | −21 | 2 | opaque | −3.0 |
| 43 | 70 A2 | 50 B2 | 400 C2 | 200 C3 | −22 | 0 | opaque | −3.0 |
| 44 | 70 A2 | 50 B2 | 535 C2 | 265 C3 | −24 | 0 | opaque | −3.3 |
| 45 | — | — | 400 C3 | 200 C5 | −19 | 4 | opaque | −2.8 |
| 46 | 50 A1 | — | 400 C3 | 200 C5 | −15 | 30 | almost clear | 0.8 |
| 47 | 50 A1 | 20 B3 | 400 C3 | 200 C5 | −20 | 3 | opaque | −2.6 |

The tests show that the impairment of the cold flow properties, for example of the CFPP and of the paraffin dispersancy, of middle distillates additized with flow improvers can be compensated for only by addition of the inventive nucleators. Higher dosage of the flow improver alone cannot achieve this result.

The invention claimed is:

1. A method for improving the response behavior of mineral oil cold flow improvers C) in middle distillates which comprise at least one ashless nitrogen-containing detergent additive A), wherein A) is an oil-soluble amphiphilic compound which comprises at least one alkyl or alkenyl radical which is bonded to a polar group, wherein the alkyl or alkenyl radical comprises 10 to 500 carbon atoms and the polar group comprises 2 or more nitrogen atoms, comprising the step of nucleating a paraffin crystallization with at least one oil-soluble compound B), wherein B) is selected from copolymers of ethylene and 5 to 10.5 mol % of at least one ethylenically unsaturated carboxylic ester and wherein C) is different than B), and wherein C) comprises oil-soluble polar nitrogen compounds which are reaction products of compounds of the formula $NR^6R^7R^8$ in which $R^6$, $R^7$ and $R^8$ may be the same or different, and at least one of these groups is $C_8$-$C_{36}$-alkyl, $C_6$-$C_{36}$-cycloalkyl, or $C_8$-$C_{36}$-alkenyl and the remaining groups are either hydrogen, $C_1$-$C_{36}$-alkyl, $C_2$-$C_{36}$-alkenyl, cyclohexyl or a group of the formula $-(A\text{-}O)_x\text{-}E$ or $—(CH_2)_n—NYZ$ in which A is an ethyl or propyl group, x is from 1 to 50, E=H, $C_1$-$C_{30}$-alkyl, $C_5$-$C_{12}$-cycloalkyl or $C_6$-$C_{30}$-aryl, and n=2, 3 or 4, and Y and Z are each independently H, $C_1$-$C_{30}$-alkyl or $-(A\text{-}O)_x$, wherein A is an ethyl or propyl group, x is from 1 to 50, with compounds which contain at least one acyl group, wherein the middle distillate contains 10 to 10 000 ppm of an ashless nitrogen-containing detergent additive A) and wherein, based on one part by weight of the nitrogen-containing detergent additive A), 0.01 to 10 parts by weight of the oil-soluble compound B) are used.

2. A method as claimed in claim 1, wherein the ashless nitrogen-containing detergent additive A) has an alkyl radical having 15 to 500 carbon atoms.

3. A method as claimed in claim 2, wherein the alkyl radical is derived from oligomers of lower olefins having 3 to 6 carbon atoms or mixtures thereof.

4. A method as claimed in claim 3, wherein the alkyl radical is derived from a mixture of oligomers of lower olefins having 3 to 6 carbon atoms which contains more than 70 mol % of 2-methyl-2-butene, 2,3-dimethyl-2-butene and/or isobutene.

5. A method as claimed in claim 1, wherein the ashless nitrogen-containing detergent additive A) is prepared using high-reactivity low molecular weight polyolefins selected from the group consisting of poly(isobutylene), poly(2-butene), poly(2-methyl-2-butene), poly(2,3-dimethyl-2-butene), poly(ethylene-co-isobutylene) and atactic poly(propylene), having a proportion of terminal double bonds of at least 75 mol %.

6. A method as claimed in claim 1, wherein the ashless nitrogen-containing detergent additive A) comprises a polar component which is derived from polyamines of the formula $$(R^9)_2N\text{-}[A\text{-}N(R^9)]_q—(R^9)$$

in which each $R^9$ is independently hydrogen, an alkyl or hydroxyalkyl radical having up to 24 carbon atoms, a polyoxyalkylene radical $(A\text{-}O)_r—$ or polyiminoalkylene radical $[A\text{-}N(R^9)]_s—(R^9)$, wherein at least one $R^9$ is hydrogen, q is an integer from 1 to 19, A is an alkylene radical having 1 to 6 carbon atoms, and r and s are each independently integers from 1 to 50.

7. A method as claimed in claim 6, wherein $R^9$ is hydrogen and q is greater than or equal to 3.

8. A method as claimed in claim 1, wherein the ashless nitrogen-containing detergent additive A) comprises an oil-soluble alkyl radical and a polar head group, and the oil-soluble alkyl radical and the polar head group are joined to one another via a C—N bond or via an ester, amide or imide bond.

9. A method as claimed in claim 1, wherein the ashless nitrogen-containing detergent additive A) has a mean molecular weight determined by vapor pressure osmometry of more than 800 g/mol.

10. A method as claimed in claim 1, wherein the ethylenically unsaturated carboxylic ester is an ester of vinyl alcohol with $C_1$-$C_{20}$ carboxylic acids.

11. A method as claimed in claim 10, wherein the ethylenically unsaturated carboxylic ester is selected from the group consisting of vinyl acetate, vinyl propionate, vinyl butyrate, vinyl isobutyrate, vinyl pentanoate, vinyl pivalate, vinyl hexanoate, vinyl-n-octanoate, vinyl-2-ethylhexanoate, vinyl neononanoate, vinyl isodecanoate, vinyl neodecanoate, vinyl neoundecanoate and vinyl isotridecylate.

12. A method as claimed in claim 1, wherein the ethylenically unsaturated carboxylic ester is an ester of unsaturated carboxylic acids with $C_1$-$C_{20}$ alcohols.

13. A method as claimed in claim 12, wherein the ethylenically unsaturated carboxylic ester is selected from the group consisting of methyl acrylate, ethyl acrylate, propyl acrylate, butyl acrylate, 2-ethylhexyl acrylate, lauryl acrylate, and the corresponding esters of methacrylic acid.

14. A method as claimed in claim 1, wherein the copolymers of ethylene and ethylenically unsaturated carboxylic esters contain up to 3 mol % of structural units which derive from olefins having 3 to 8 carbon atoms, with the proviso that the total comonomer content is not more than 10.5 mol %.

15. A method as claimed in claim 1, wherein the melt viscosity, measured at 140° C., of the copolymers of ethylene B) is between 100 and 5000 mPas.

16. A method as claimed in claim 1, wherein the ratio between detergent additive A) and copolymers of ethylene B) is 0.01 to 10 parts by weight of B) per part by weight of detergent additive, based in each case on the active ingredient.

17. An additive comprising a) at least one ashless nitrogen-containing detergent additive A) which is an oil-soluble amphiphilic compound comprising at least one alkyl or alkenyl radical bonded to a polar group, where the alkyl or alkenyl radical comprises 10 to 500 carbon atoms and the polar group comprises 2 or more nitrogen atoms, b) at least one oil-soluble compound B) selected from copolymers of ethylene and 5 to 10.5 mol % of at least one ethylenically unsaturated carboxylic ester, and a mineral oil cold flow improver C), wherein C) is different than B), and wherein C) comprises oil-soluble polar nitrogen compounds which are reaction products of compounds of the formula $NR^6R^7R^8$ in which $R^6$, $R^7$ and $R^8$ may be the same or different, and at least one of these groups is $C_8$-$C_{36}$-alkyl, $C_6$-$C_{36}$-cycloalkyl, or $C_8$-$C_{36}$-alkenyl and the remaining groups are either hydrogen, $C_1$-$C_{36}$-alkyl, $C_2$-$C_{36}$-alkenyl, cyclohexyl or a group of the formula $-(A\text{-}O)_x\text{-}E$ or $—(CH_2)_n—NYZ$ in which A is an ethyl or propyl group, x is from 1 to 50, E=H, $C_1$-$C_{30}$-alkyl, $C_5$-$C_{12}$-cycloalkyl or $C_6$-$C_{30}$-aryl, and n=2, 3 or 4, and Y and Z are each independently H, $C_1$-$C_{30}$-alkyl or $-(A\text{-}O)_x$, wherein A is an ethyl or propyl group, x is from 1 to 50, with compounds which contain at least one acyl group, wherein, based on one part by weight of the nitrogen-containing detergent additive A), 0.01 to 10 parts by weight of the oil-soluble compound B) are used.

18. A middle distillate having a sulfur content of less than 100 ppm and a 90% distillation point of less than 360° C., comprising an additive as claimed in claim 17.

19. The middle distillate as claimed in claim 18, which contains up to 40% by volume of oils of animal and/or plant origin, which are triglycerides of fatty acids having 10 to 24 carbon atoms or the fatty acid esters of methanol or ethanol which are obtainable therefrom.

* * * * *